US007318481B2

(12) United States Patent
Richard

(10) Patent No.: US 7,318,481 B2
(45) **Date of Patent: *Jan. 15, 2008**

(54) SELF-CONFORMING SCREEN

(75) Inventor: Bennett M. Richard, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 290 days.

This patent is subject to a terminal disclaimer.

(21) Appl. No.: 11/105,071

(22) Filed: Apr. 13, 2005

(65) Prior Publication Data

US 2005/0205263 A1 Sep. 22, 2005

Related U.S. Application Data

(63) Continuation-in-part of application No. 10/226,941, filed on Aug. 23, 2002.

(51) Int. Cl.
*E21B 43/08* (2006.01)
*E21B 43/10* (2006.01)

(52) U.S. Cl. ..... 166/369; 166/227; 166/380

(58) Field of Classification Search ..... 166/227, 166/369, 380, 381, 382, 207
See application file for complete search history.

(56) References Cited

U.S. PATENT DOCUMENTS

| | | | |
|---|---|---|---|
| 2,849,070 | A | 8/1958 | Maly |
| 2,942,668 | A | 6/1960 | Maly et al. |
| 2,945,541 | A | 7/1960 | Maly et al. |
| 2,981,332 | A | 4/1961 | Miller et al. |
| 2,981,333 | A | 4/1961 | Miller et al. |
| 3,099,318 | A | 7/1963 | Miller et al. |
| 3,477,506 | A | 11/1969 | Malone |
| 4,262,744 | A | 4/1981 | Mitchell et al. |
| 4,862,967 | A | 9/1989 | Harris |
| 4,897,139 | A | 1/1990 | Wood |
| 4,967,846 | A | 11/1990 | Wood |
| 5,048,605 | A | 9/1991 | Toon et al. |
| 5,195,583 | A | 3/1993 | Toon et al. |
| 5,271,469 | A | 12/1993 | Brooks et al. |
| 5,667,011 | A | 9/1997 | Gill et al. |
| 5,738,171 | A | 4/1998 | Szarka |
| 5,901,789 | A | 5/1999 | Donnelly et al. |
| 6,012,522 | A | 1/2000 | Donnelly et al. |
| 6,213,209 | B1 | 4/2001 | Nguyen et al. |
| 6,250,385 | B1 | 6/2001 | Montaron |
| 6,253,850 | B1 | 7/2001 | Nazzai et al. |
| 6,263,966 | B1 | 7/2001 | Haut et al. |

(Continued)

FOREIGN PATENT DOCUMENTS

| | | | |
|---|---|---|---|
| GB | 2347446 | A | 9/2000 |

(Continued)

*Primary Examiner*—Hoang Dang
(74) *Attorney, Agent, or Firm*—Steve Rosenblatt

(57) ABSTRACT

A screen assembly has a material that conforms to the borehole shape after insertion. The assembly comprises a compliant layer that takes the borehole shape on expansion. The outer layer is formed having holes to permit production flow. The material that is selected preferably swells with heat and preferably comprises a shape memory foam that is thermoset. The base pipe can have a screen over it to act as an underlayment for support of the conforming layer or alternatively for screening. The conforming layer can expand by itself or expansion can also occur from within the base pipe.

17 Claims, 2 Drawing Sheets

U.S. PATENT DOCUMENTS

| | | | |
|---|---|---|---|
| 6,302,207 | B1 | 10/2001 | Nguyen et al. |
| 6,431,282 | B1 | 8/2002 | Bosma et al. |
| 6,530,431 | B1 | 3/2003 | Castano-Mears et al. |
| 6,543,545 | B1 | 4/2003 | Chatterji et al. |
| 6,668,928 | B2 | 12/2003 | Brothers |
| 6,769,484 | B2 | 8/2004 | Longmore |
| 2002/0084070 | A1 | 7/2002 | Voll et al. |
| 2003/0075323 | A1 | 4/2003 | Vercaemer et al. |
| 2003/0136562 | A1 | 7/2003 | Robison et al. |
| 2003/0196820 | A1 | 10/2003 | Patel |
| 2004/0020662 | A1 | 2/2004 | Freyer |
| 2004/0055760 | A1 | 3/2004 | Nguyen |
| 2004/0112609 | A1 | 6/2004 | Whanger et al. |
| 2004/0164499 | A1 | 8/2004 | Murakami et al. |
| 2004/0168799 | A1 | 9/2004 | Simonds et al. |
| 2004/0261990 | A1 | 12/2004 | Bosma et al. |
| 2005/0171248 | A1 | 8/2005 | Li et al. |

FOREIGN PATENT DOCUMENTS

| | | |
|---|---|---|
| WO | WO 00/39432 | 7/2000 |
| WO | WO 00/61914 | 10/2000 |
| WO | WO 02/059452 A1 | 8/2002 |
| WO | WO 2005/031111 A1 | 4/2005 |

SELF-CONFORMING SCREEN

PRIORITY INFORMATION

This application is a continuation-in-part of U.S. patent application Ser. No. 10/226,941, filed on Aug. 23, 2002.

FIELD OF THE INVENTION

The field of this invention is downhole screens and more particularly those that can be expanded in open hole to close-off an irregularly shaped borehole.

BACKGROUND OF THE INVENTION

In the past sand control methods have been dominated by gravel packing outside of downhole screens. The idea was to fill the annular space outside the screen with sand to prevent the production of undesirable solids from the formation. More recently, with the advent of tubular expansion technology, it was thought that the need for gravel packing could be eliminated if a screen or screens could be expanded in place to eliminate the surrounding annular space that had heretofore been packed with sand. Problems arose with the screen expansion technique as a replacement for gravel packing because of wellbore shape irregularities. A fixed swage would expand a screen a fixed amount. The problems were that a washout in the wellbore would still leave a large annular space outside the screen. Conversely, a tight spot in the wellbore could create the risk of sticking the fixed swage.

One improvement of the fixed swage technique was to use various forms of flexible swages. In theory these flexible swages were compliant so that in a tight spot they would flex inwardly and reduce the chance of sticking the swage. On the other hand, if there was a void area, the same problem persisted in that the flexible swage had a finite outer dimension to which it would expand the screen. Therefore, the use of flexible swages still left the problem of annular gaps outside the screen with a resulting undesired production of solids when the well was put on production from that zone.

Prior designs of screens have used pre-compressed mat held by a metal sheath that is then subjected to a chemical attack when placed in the desired location downhole. The mat is then allowed to expand from its pre-compressed state. The screen is not expanded. This design is described in U.S. Pat. Nos. 2,981,332 and 2,981,333. U.S. Pat. No. 5,667,011 shows a fixed swage expanding a slotted liner downhole. U.S. Pat. Nos. 5,901,789 and 6,012,522 show well screens being expanded. U.S. Pat. No. 6,253,850 shows a technique of inserting one solid liner in another already expanded slotted liner to blank it off and the used of rubber or epoxies to seal between the liners. U.S. Pat. No. 6,263,966 shows a screen with longitudinal pleats being expanded downhole. U.S. Pat. No. 5,833,001 shows rubber cured in place to make a patch after being expanded with an inflatable. Finally, U.S. Pat. No. 4,262,744 is of general interest as a technique for making screens using molds.

The apparatus and method of the present invention addresses this issue by providing a screen assembly with an outer layer that can conform to the borehole shape upon expansion. In the preferred embodiment the material is selected that will swell in contact with wellbore fluids to further promote filling the void areas in the borehole after expansion. In an alternative design, screen expansion is not required and the outermost layer swells to conform to the borehole shape from contact with well fluids or other fluids introduced into the wellbore. The screen section is fabricated in a manner that reduces or eliminates welds. Welds are placed under severe loading in an expansion process, so minimizing or eliminating welds provides for more reliable screen operation after expansion. These and other advantages of the present invention will become more apparent to one skilled in the art from a review of the description of the preferred embodiment and the claims that appear below.

SUMMARY OF THE INVENTION

A screen assembly has a material that conforms to the borehole shape after insertion. The assembly comprises a compliant layer that takes the borehole shape on expansion. The outer layer is formed having holes to permit production flow. The material that is selected preferably swells with heat and preferably comprises a shape memory foam that is thermoset. The base pipe can have a screen over it to act as an underlayment for support of the conforming layer or alternatively for screening. The conforming layer can expand by itself or expansion can also occur from within the base pipe.

DETAILED DESCRIPTION OF THE PREFERRED EMBODIMENT

Figure 1:
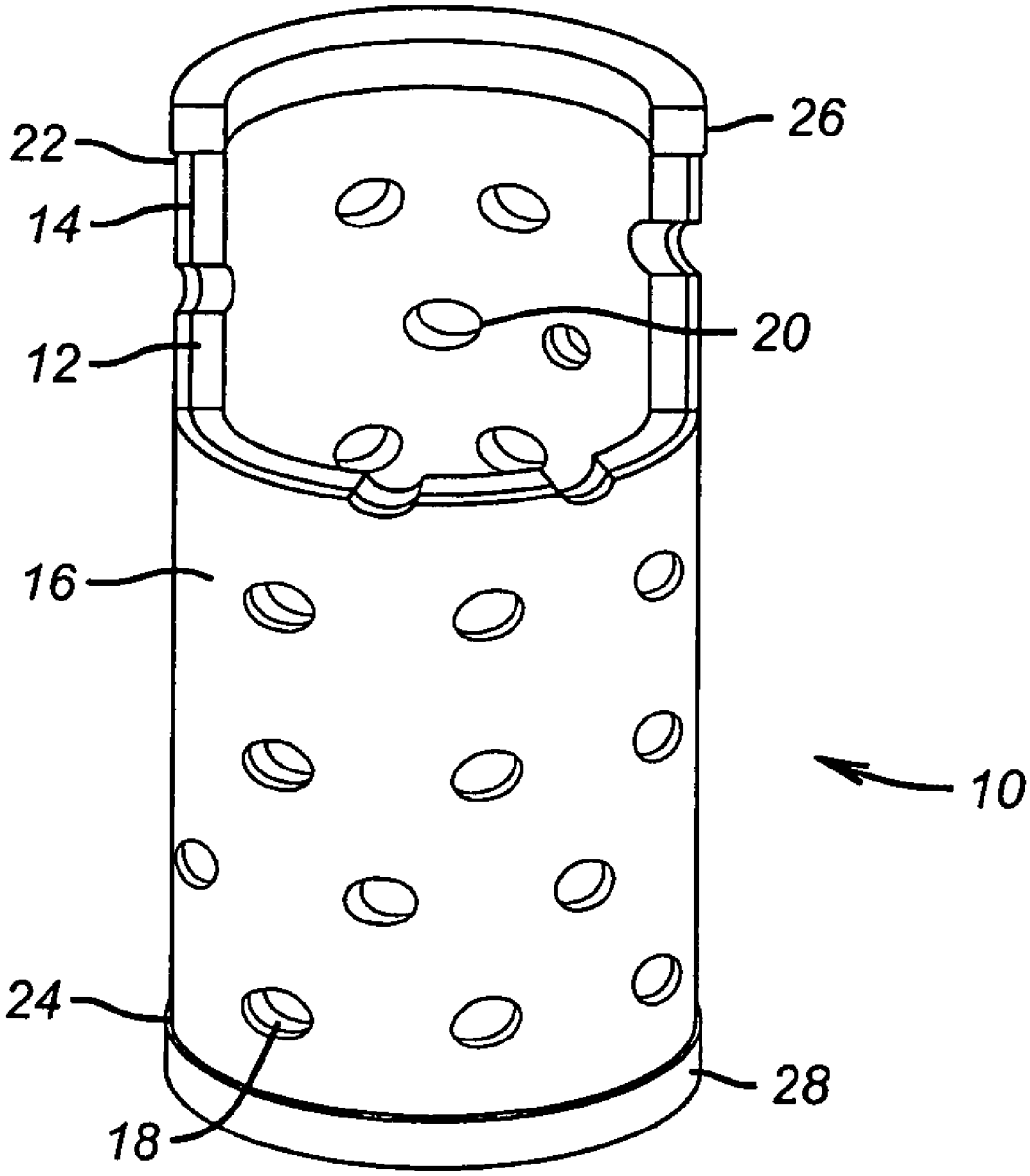
FIG. 1 is a cutaway view of the screen shown in elevation.

FIG. 1 illustrates a portion of a section of screen 10. It has a base pipe 12 over which is the screen 14 and over which is outer conforming layer 16. Layer 16 has a plurality of holes 18. The base pipe 12 also has holes 20. The actual filter material or screen 14 can be a mesh or a weave or other known filtration products. The conforming layer 16 is preferably soft so that it will flow upon expansion of the screen 10. The preferred material is one that will swell when exposed to well fluids for an extended period of time. Three examples are nitrile, natural rubber, and AFLAS. In an alternative embodiment, the conforming layer 16 swells sufficiently after being run into the wellbore, to contact the wellbore, without expansion of the screen 10. Shown schematically at the ends 22 and 24 of screen 10 are stop rings 26 and 28. These stop rings will contain the conforming layer 16 upon expansion of screen 10 against running longitudinally in an annular space outside screen 10 after it is expanded. Their use is optional.

The manner of assembly of the screen 10 is another aspect of the invention. The conforming layer 16 can have an internal diameter that allows it to be slipped over the screen material 14. The assembly of the screen material 14 and the conforming layer 16 are slipped over the base pipe 12. Thereafter, a known expansion tool is applied internally to base pipe 12 to slightly expand it. As a result, the screen material 14 and the conforming layer 16 are both secured to the base pipe 12 without need for welding. This is advantageous because when the screen 10 is run in the wellbore and expanded, the expansion process can put large stresses on welds that may cause screen failure. An alternative way to assemble screen 10 is to attach the screen material 14 to the base pipe 12 in the manner just described and then to cure the conforming layer 16 right onto the screen material 14. As another option a protective outer jacket (not shown) can be applied over screen material 14 and the conforming layer 16 mounted above. The joining process even with the optional perforated protective jacket (not shown) is the outward expansion from within the base pipe 12, as previously described.

Figure 2:
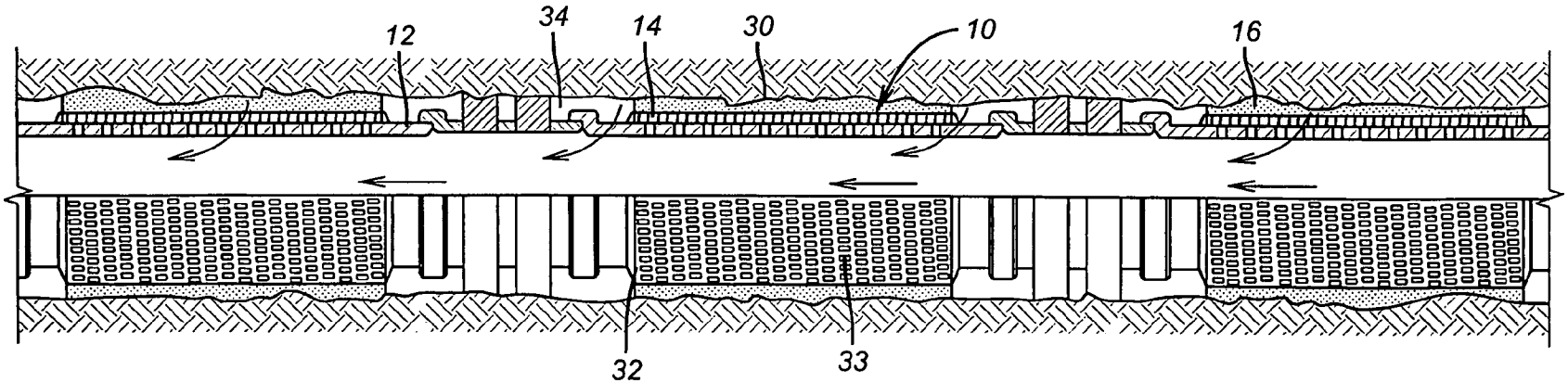
FIG. 2 is a section view of an assembly of screens, one of which is shown in FIG. 1, in the expanded position downhole.

The holes 18 can have a variety of shapes. Their function is to allow formation fluids to pass after expansion. They can be round holes or slots or other shapes or combinations of shapes. The conforming layer 16 can be made of a polymeric material and is preferably one that swells on sustained exposure to well fluids to better conform to irregular shapes in the borehole 30, as shown in FIG. 2. FIG. 2 also shows the outer protective jacket 32 that goes over screen material 14 and below conforming layer 16 to protect the screen material 14 when run into the borehole 30. Jacket 32 is a known product that has punched openings 33 and can optionally be used if the conforming layer 16 is used. The reason it is optional is that the conforming layer 16 to some degree provides the desired protection during run in. Additionally, without jacket 32, the conforming layer 16 can be made thicker to better fill in void volume 34 in the annular space around a screen 10 after expansion. The thickness of the conforming layer 16 is limited by the borehole and the outer diameter of the components mounted inside of it. It is preferred that the conforming layer 16 be squeezed firmly as that promotes its movement to fill voids in the surrounding annular space.

Those skilled in the art will appreciate that the present invention allows for fabrication of an expandable screen with welds between layers eliminated. The use of the conforming material 16 allows a variety of expansion techniques to be used and an improvement of the ability to eliminate void spaces outside the expanded screen caused by borehole irregularities. Alternatively, the conforming material 16 can swell sufficiently without downhole expansion of the screen 10 to allow for the elimination of the need to gravel pack. If the material swells due to exposure to fluids downhole, its use as the conforming layer 16 is desired. A protective jacket 32 under the conforming layer 16 may be used to protect the screen material 14 during run in.

The conforming layer 16 can be a foam that is preferably thermo-setting but can also be a thermo-plastic. The conforming layer 16 is shown with a cylindrical shape, but this can be varied, such as by means of concave ends or striated areas (not shown), to facilitate deployment, or to enhance the filtration characteristics of the layer. The conforming layer 16 is preferably composed of an elastic memory foam such as an open cell syntactic foam. This type of foam has the property of being convertible from one size and shape to another size and/or shape, by changing the temperature of the foam. This type of foam can be formed into an article with an original size and shape as desired, such as a cylinder with a desired outer diameter. The foam article thusly formed is then heated to raise its temperature to its transition temperature. As it achieves the transition temperature, the foam softens, allowing the foam article to be reshaped to a desired interim size and shape, such as by being compressed to form a smaller diameter cylinder. The temperature of the foam article is then lowered below the transition temperature, to cause the foam article to retain its interim size and shape. When subsequently raised again to its transition temperature, the foam article will return to its original size and shape.

The cylindrical foam conforming layer 16 can be originally formed onto the screen 10 or the base pipe 12 by wrapping a foam blanket with the desired original outer diameter $OD_1$. Alternatively, the process for forming the conforming layer 16 on the base pipe 12 or screen 10 can be any other process which results in the conforming layer 16 having the desired original diameter, such as by molding the foam directly. The desired original outer diameter $OD_1$ is larger than the bore hole diameter (BHD} in which the assembly will be deployed. For instance, a conforming layer 16 having an original outer diameter $OD_1$ of 10 inches might be formed for use in an 8.5 inch diameter borehole.

The foam material composition is formulated to achieve the desired transition temperature. This quality allows the foam to be formulated in anticipation of the desired transition temperature to be used for a given application. For instance, in use with the present invention, the foam material composition can be formulated to have a transition temperature just slightly below the anticipated downhole temperature at the depth at which the assembly will be used. This causes the conforming layer 16 to expand at the temperature found at the desired depth, and to remain expanded against the bore hole wall. Downhole temperature can be used to expand the conforming layer 16; alternatively, other means can be used, such as a separate heat source. Such a heat source could be a wireline deployed electric heater, or a battery fed heater. For example, such a heat source could be mounted to the base pipe 12, incorporated into it, or otherwise mounted in contact with the foam conforming layer 16. The heater could be controlled from the surface of the well site, or it could be controlled by a timing device or a pressure sensor. Still further, an exothermic reaction could be created by chemicals pumped downhole from the surface, or heat could be generated by any other suitable means.

The conforming layer 16 can be made to act as the sole filtration agent without the use of any screen material such as 14. This is because the nature of the conforming material is to be porous. However, the normal technique for its production is a mold leaves an impervious coating on the entire outer periphery. This quality allows the material to be used as a packer material essentially in the condition in which it is removed from the mold. However, if the exterior surface that ultimately has contact with the borehole wall has the impervious layer stripped off or otherwise removed, the conforming layer 16 can be mounted to a base pipe 12 or a screen 14 and it can act solely as the only filtration material or in conjunction with the screen 14. The screen 14 can be configured exclusively for structural support of the conforming material 16 to keep it from going through the base pipe 12 when well fluids are filtered through it or omitted altogether. The uphole and downhole ends of the conforming material 16 may have the impervious layer from the molding process of manufacturing left on to better direct flow to the openings in the base pipe 12.

The conforming material can preferably be a shape memory polymer that is porous and thermosetting although thermoplastic materials can also be used if they are porous or can be produced in that condition.

The foregoing disclosure and description of the invention are illustrative and explanatory thereof, and various changes in the size, shape and materials, as well as in the details of the illustrated construction, may be made without departing from the spirit of the invention.

I claim:

1. A well completion method, comprising:

covering at least one base pipe with a porous conforming material; running said base pipe to a desired location in the wellbore with said conforming material radially not constricted;

allowing the conforming material to bridge an annular gap to the wellbore wall without base pipe expansion;

filtering fluids through said conforming material to said base pipe.

2. The method of claim 1, comprising:

expanding the base pipe into said conforming material.

3. The method of claim 1, comprising:

selecting a material for said conforming material that is a foam.

4. The method of claim 1, comprising:

selecting a material for said conforming material that is a shaped memory polymer.

5. The method of claim 4, comprising:

selecting a material for said conforming material that is thermosetting.

6. The method of claim 4, comprising:

selecting a material for said conforming material that is thermoplastic.

7. The method of claim 1, comprising:

providing a heat source downhole to initiate said bridging.

8. The method of claim 1, comprising:

providing an impervious layer on said conforming material;

removing said impervious layer from said conforming material to expose pores therethrough.

9. The method of claim 1, comprising:

providing a support member between said base pipe and said conforming material.

10. The method of claim 9, comprising:

using a screen for said support member.

11. The method of claim 1, comprising:

allowing said conforming material to swell into contact with the wellbore wall.

12. The method of claim 3, comprising:

selecting a material for said conforming material that is a shaped memory polymer.

13. The method of claim 12, comprising:

selecting a material for said conforming material that is thermosetting.

14. The method of claim 13, comprising:

providing an impervious layer on said conforming material;

removing an impervious layer from said conforming material to expose pores therethrough.

15. The method of claim 14, comprising:

providing a support member between said base pipe and said conforming material.

16. The method of claim 15, comprising:

using a screen for said support member.

17. The method of claim 16, comprising:

expanding the base pipe into said screen and conforming material.

* * * * *